United States Patent [19]

Cross et al.

[11] Patent Number: 4,696,106

[45] Date of Patent: Sep. 29, 1987

[54] SINGLE USE DISPOSABLE MEDICAL RAZOR

[75] Inventors: Robert J. Cross, Haverhill; William A. Barabino, 19 Sunset Ave., N. Reading, Mass. 01864

[73] Assignee: William A. Barabino, N. Reading, Mass.

[21] Appl. No.: 877,332

[22] Filed: Jun. 23, 1986

[51] Int. Cl.[4] ..... B26B 21/44

[52] U.S. Cl. ..... 30/41; 30/86

[58] Field of Search ..... 30/41, 86, 90; 222/206, 222/319, 386; 604/110

[56] References Cited

U.S. PATENT DOCUMENTS

| | | | |
|---|---|---|---|
| 1,744,902 | 1/1930 | Johnston | 30/41 |
| 1,898,803 | 2/1933 | Young | 30/41 X |
| 3,703,765 | 11/1972 | Perez | 30/41 |
| 4,459,997 | 7/1984 | Sarstedt | 604/110 X |
| 4,562,643 | 1/1986 | Cataudella | 30/41 |

FOREIGN PATENT DOCUMENTS

| | | | |
|---|---|---|---|
| 1150980 | 5/1969 | United Kingdom | 604/110 |

*Primary Examiner*—E. R. Kazenske
*Assistant Examiner*—Michael D. Folkerts
*Attorney, Agent, or Firm*—Richard C. Litman

[57] ABSTRACT

A single use disposable medical razor having an elongated handle member within which is disposed a hollow portion defining a reservoir extending from a proximate end to a distal end, closure means for the reservoir at the proximate end and a dispensing orifice at the distal end of the reservoir, plunger means transversely disposed to the hollow portion of the reservoir and essentially filling generally a first half of the reservoir adjacent the proximate end thereof and adapted to move along throughout a length of the second half of the reservoir from about a midportion of the hollow portion to a distal end thereof, the reservoir adapted for storing shaving cream in the second half thereof, a race means disposed along an element of the reservoir and extending less than the entire length of the handle from about a midpoint of the hollow portion to the proximate end thereof essentially generally along the first half, protrusion means extending from the plunger means outwardly through the race means for grasping manually by a user and, after removal of an adhesive tape from the orifice, whereby displacement of the plunger means by grasping the protrusion means and moving it along the race means moves the plunger into the second half of the reservoir for causing the shaving cream to be dispensed from the dispensing orifice in the distal end.

6 Claims, 8 Drawing Figures

SINGLE USE DISPOSABLE MEDICAL RAZOR

BACKGROUND OF THE INVENTION

Field of the Invention

The invention relates to an improved disposable razor having a self-contained supply of brushless shave cream in its hollow handle in an amount that is sufficient to shave approximately 40 to 45 square inches. After one use of the device the razor is discarded.

Due to certain and various social behavior, transmittal of disease via blood or by its components has become a substantively serious concern and issue of public health. In particular, Acquired Immune Deficiency Syndrome (AIDS), Hepatitus B, Hepatitus Non-A and Hepatitus Non-B are disease that are transmitted by blood either by direct transfusion or indirectly by the use of contaminated appliances.

A very real control problem seems to exist in the medical community, including hospitals, where pre-operational preparations, biopsy punch preparation, maternal delivery or emergency suturing may require shaving about small body areas. More generally, the shaving procedure relies on the availability of a centrally located and conveniently acessible multiuse can or container of aerosol shaving cream. As a practical matter, it is found rarely that such container(s) are available when needed because the container(s) usually finds itself relocated for use outside the required areas or of the hospital. Patients then receive a dry shave or at best a shave with lather from a cake of hand soap or the like. Further, a pre-operational prep nurse when given a container of aerosol shaving cream will use it and a single razor to complete a number of scheduled pre-operational preparations. Further, what amounts to a community razor is sometimes routinely used in the emergency room of medical facilities for various shaving requirements over several intervals and on several patients, some of whom may possess excessively hairy sections or areas that thereafter have to accept electrodes of an EKG or for preparing an area for suturing and the like. Such practice may result in the transmission of disease due to razor "nicks" and "pre-scalping".

A nominal length of the standard commercially available disposable razor is generally 90 mm. and by using approximately 42 mm of the hollow handle as a reservoir, an approximately five-tenths of a gram of shaving cream may be stored in the nominal 2700 cubic mm volume therein. This amount is sufficient to shave approximately 50 square inches, or 322 $cm^2$ of skin surface.

Description of the Prior Art

Various prior art razors and brushless shave cream applicators and devices, or the like, as well as apparatus and method of construction in general, and shaving apparatus that permit repetitive use either by means of an attachable and replaceable supply of shave cream in the form of an aerosol container, or a chamber in a modified handle that accepts refilling, are found to be known, and exempliary of the U.S. prior art are the following:

U.S. Pat. No. 4,377,034: Druash
U.S. Pat. No. 4,228,587: Bennett
U.S. Pat. No. 4,077,119: Sellers
U.S. Pat. No. 4,074,428: Roberts
U.S. Pat. No. 4,023,269: Lopez, Jr.

U.S. Pat. No. 3,873,511: Pass

The Druash, Bennett, Sellers and Pass Patents disclose a reusable safety razor kit containing shaving cream, and no manual dispensing of shaving cream stored at nominal pressures is available; and Bennett further discloses merely a detachable razor having a removeable shave cream chamber and a removeable plunger for refilling operations. Roberts and Lopez merely relate to arrangements including pressurized containers in reusable units. None of these suggest containing unpressurized shaving cream dispensible by plunger means and with a one-time stroke of the plunger.

These patents or known prior uses teach and disclose various types of razor devices of sorts and of various manufactures and the like as well as methods of their construction, but none of them whether taken singly or in combination disclose the specific details of the combination of the invention in such a way as to bear upon the claims of the present invention.

Summary of the Invention

An object, advantage and feature of the invention is to provide a novel disposable razor having a self-contained supply of brushless shave cream in its hollow handle in an amount that is sufficient to shave approximately 40 to 45 square inches, or by decimal metrication, 258 to 290 $cm^2$ and after such use the razor is discarded.

The present invention seeks to eliminate all these problematical circumstances by utilizing the teaching of the present invention and in part it utilizes a general configuration of available disposable razor devices, whether the handle is centrally hollow and of a generally circular, square, rectangular or the like in configuration. A lower half of the handle is enclosed forming a reservoir, and an upper half of the handle may be open on one side so forming a race or channel. These and other objects are incorporated in the invention of the present device, and further include a plunger that may normally reside in or adjacent the race until actual use thereof.

Also an object of the invention is to provide a simple and direct method for the improved construction of a single use disposable medical razor type device for providing an adequate one-time use razor and shaving cream-containing supply that are essentially always in combination with each other.

Because of the needs of the present and the circumstances of its use, the plunger may be so specially constructed within the purview of the present invention so the plunger renders the razor essentially useless for its refilling for subsequent repeated use. Medical use of devices of the present invention may provide for issuance of the device to be part of every hospital admissions kit issued to male patients for their routine shaving needs.

A further object of the invention is to provide the shaving cream container portion of the razor adaptable for containing a mixture of various fungicides, viricides and bactericides and the like, adaptable to kill any organisms which may be carried on the hands or objects associated with the hands of an hospital employe doing the shaving process.

A disposable medical razor for single use according to the present invention has a handle containing a shaving cream dispenser. The handle forms a reservoir for rezeiving a quantity of shaving cream. A slidably disposed plunger within the reservoir tends to force the shaving cream out through a dispensing orifice in the reservoir when the plunger is moved axially by the user moving a protrusion exterially attached to the plunger. A slot disposed generally parallel to the direction of the displacement of the plunger within the assembly is provided in an extension to the reservoir for movement of the protrusion form one end of the extension of the reservoir to a point near the portion of the reservoir where shaving cream is stored. The dispensing orifice is provided in the end of the reservoir fartherest spaced from the plunger when the reservoir is in its filled condition. Movement of the protrusion and hence the plunger in a direction toward the opening causes the shaving cream to be dispensed from the reservoir through the dispensing orifice. A sectional measurements of the reservoir and the plunger are generally uniform throughout the length measurements with the plunger measurements being slightly less that the reservoir measurements and thereby result in a generally snug fit of the plunger within the reservoir. The dispensing orifice is in the base portion of the handle and is preferably constructed integrally with the handle to prevent refilling of the reservoir. The orifice is preferably sealed by applying a section of adhesive tape means or other similar member also generally adapted for its one-time use; however it may be sealed by other means such as by a plastic plug member.

A further advantage of the present invention in its aid to preventing reuse of the razor and possible transmission of infection mentioned above, the razor assembly with the blade are preferably formed as an integral part thereof. The blade is preferably a single blade, but of course within the teaching of the prior art, the blade may be a double blade so hair that is essentially short may be conveniently cut or shaved. The razor preferably has a means for preventing the plunger from being retracted again within the reservoir, and again as an aid in discouraging or preventing reuse of the razor.

Another object of the invention is to provide a novel and improved method of selectively making the handle, reservoir and the plunger for a one-time dispensing of shaving cream.

These together with other objects and advantages which will become subsequently apparent reside in the details of the process and operation thereof as more fully hereinafter is described and claimed, reference being had to the accompanying drawings forming a part hereof, wherein like numerals refer to like parts throughout.

DESCRIPTION OF A PREFERRED EMBODIMENT OF THE INVENTION

Figure 1:
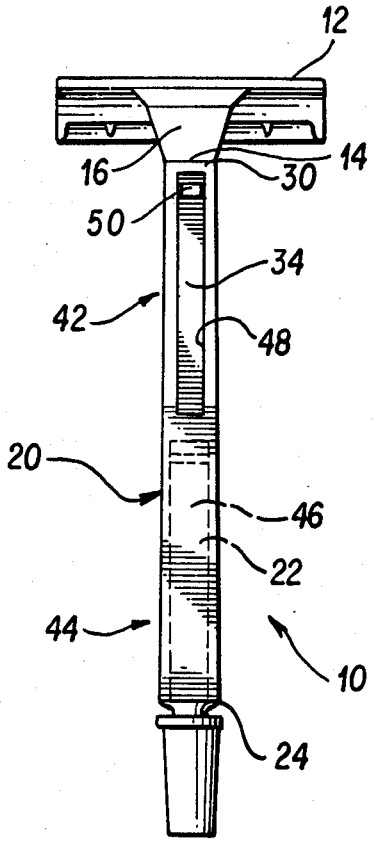
FIG. 1 is a generally rearward view, partially in section, of a single use disposable medical razor according to a preferred ambodiment and best mode of the present invention.
Figure 2:
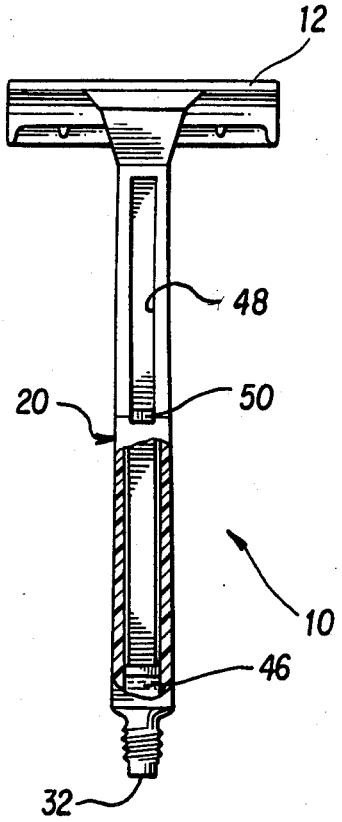
FIG. 2 is a rear view of the razor after its one-time use.
Figure 1A:
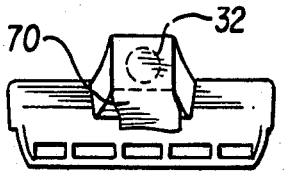
FIG. 1*a* is a bottom view of the base of the razor and embodying the concepts of the invention prior to its one-time use.
Figure 2A:
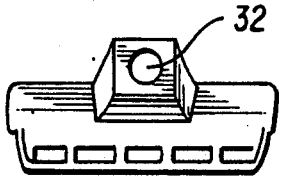
FIG. 2*a* is a bottom view of the base of the razor after its one-time use.

Referring now to the drawings there is shown a single use disposable medical razor 10 provided with a razor head 12 at a proximate end 14 of the razor 10, a connecting neck 16 disposed between the razor head 12 and an elongated handle member 20 within which is disposed a hollow portion 22 defining a reservoir extending from the proximate end 14 to a distal end 24 thereof. A closure member 30 for the reservoir is located at the proximate end 14 and an exiting or dispensing orifice 32 is located at the distal end 24 of the hollow portion 22. A plunger member 34 is transversely disposed to the hollow portion 22 of the reservoir and it essentially fills generally a first half 42 of the reservoir generally adjacent the proximate end 14 thereof and is adapted to move along throughout a length of a second half 44 of the reservoir from about a midportion of the hollow portion 22 to the distal end 24 thereof. The reservoir is adapted for storing shaving cream 46 in the second half 44 thereof, and a guide slot or race 48 is disposed along an element of the reservoir and extends less than the entire length of the handle member 20 from about a midpoint of the hollow portion to the proximate end thereof and essentially general along the first half 42.

A protrusion member 50 extends from the plunger member 34 outwardly through the race 48 for grasping the protrusion member 50 manually by a user and provides for displacement of the plunger member 34 by grasping the protrusion member 50 and moving it along the race 48 moves the plunger member 34 into the second half 44 of the reservoir for causing the shaving cream 46 to be dispensed from the dispensing orifice 32 in the distal end 24.

The razor head 12 may have a conventional throw away single blade or double blade (not shown), and a section of the reservoir may be circular, square or rectangularly in configuration. The plunger member 34 has a peripheral surface that provides a nominal friction-fit member and is slidable into the hollow portion 22 of the reservoir.

The protrusion member 50 is employed as a leverage point for finger force to push plunger member 34 toward orifice 32 for expulsion of the shaving cream 46 contained in the reservoir.

Figure 3:
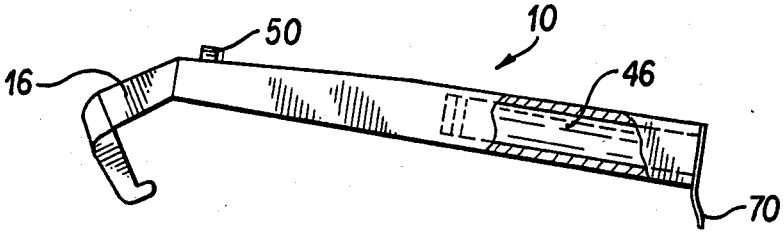
FIG. 3 shows a side view thereof prior to its one-time use.
Figure 4:
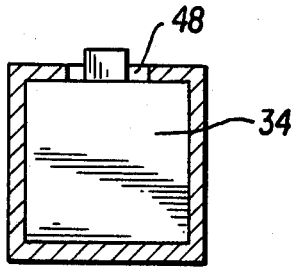
FIG. 4 shows a sectional enlargement of a plunger relative to inner walls of a reservoir containing the plunger.

FIG. 3 shows a side view of the razor 10 prior to its one-time use. Normally the slidable plunger member 34 is a single uniform dimension having nearly contiguous contact against the four walls of the reservoir or, in the case of a circular handle member 20, the plunger member 34 would have such circumferential contact therewith. FIG. 4 shows an enlarged sectional view of the plunger member 34 relative to the inner walls of the upper part of the handle member 20 of the razor 10 prior to and during its entry into reservoir. FIG. 4 shows also the guide slot or the race 48 for the protrusion member 50, not shown in section in FIG. 1.

Figure 5A:
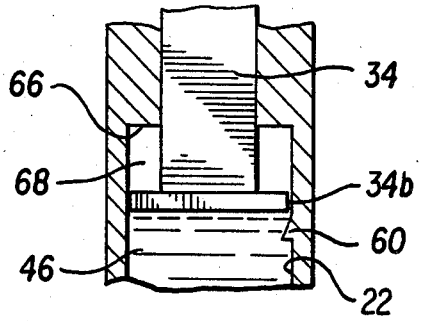
FIG. 5*a* is a sectional view taken along an axis of the plunger showing a modified form of the plunger before its one-time use.
Figure 5B:
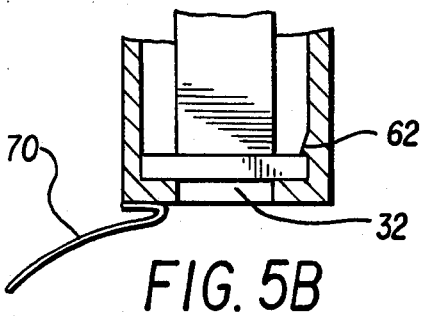
FIG. 5*b* is a sectional view taken along an axis of the plunger showing a modified form of the plunger after its one-time use.

It is possible a user would attempt to remove the plunger member 34 through the top of the reservoir, and refill it with shaving cream 46 in anticipation for subsequent use. It is equally possible that refilling the reservoir might be accomplished through the exit orifice 32 with the plunger member 34 retracted. To prevent any potential reuse, the configuration of the plunger member 34 according to FIG. 5 is alternately proposed. Rather than have the entire plunger member 34 to frictionally engage with the inner walls of the reservoir, the plunger member 34*a* is shaped in the manner as shown in FIG. 5*a* in a prior-to-use configuration or view. Inclined land 60 is molded on one side of the wall of the reservoir. Pushing forces toward orifice 32 applied at protrusion member 50 to cause a projecting face 34*b* of the plunger member 34*a* to override land 60, thus prohibiting any reverse directional force that could cause the removal of the plunger member 34*a* and provide a refilling mouth at the upper end of reservoir. At the fartherest downward travel of the projecting face 34*b* encounters and overrides land 62 similarly locking projecting face 34*b* against any reverse force that could result in allowing refilling of reservoir through orifice 32.

Referring to FIG. 5*a* there is shown surface 66 of an upper wall of the reservoir located approximately 5 mm above the standard position of the plunger 34a. Space 68 disposed between the upper surface 66 of the plunger face 34*b* and the surface of the shaving cream 46 accepts initial amount of seepage, if any, of the shaving cream 46. Materials comprising the razor 10 is preferably constructed of molded plastic materials such as polypropylene and having a conventional blade and hald in place by a plastic molded material disposed around about it. A tape seal 70 is preferably made of plastic material. The shaving cream 46 is preferably a biocidal material or compound or it is a material that includes a biocidal component wherein the biocidal material is a material selected from a group of fungicides, viricides and bactericides.

The foregoing is considered as illustrative only of the principles of the invention. Further, since numerous modifications and changes will readily occur to those skilled in the art it is not desired to limit the invention to the exact construction and operation shown and described, and accordingly, all suitable modifications and equivalents may be resorted to falling within the scope of the invention.

What is claimed and desired to be secured by Letters patent is:

1. A single use disposable medical razor comprising an elongated handle means within which is longitudinally disposed a hollow portion defining a reservoir having inner surfaces extending from a proximate end to a distal end therof, closure means for the reservoir at the proximate end of the reservoir, a dispensing orifice at the distal end of the reservoir, plunger means transversely disposed to the hollow portion of the reservoir and essentially filling generally a first half of the reservoir generally adjacent the proximate end thereof and adapted to move along throughout a length of the second half of the reservoir from about a midportion of the hollow portion to a distal end thereof, the reservoir adapted for storing shaving cream in the second half thereof, the plunger having a projecting face for contacting the shaving cream in the second half of the reservoir, a race means disposed along an element of the reservoir and extending less than the entire length of the handle from about a midpoint of the hollow portion to the proximate end thereof essentially generally along the first half, protrusion means extending from the plunger means outwardly through the race means for grasping manually by a user and whereby displacement of the plunger means is by grasping the protrusion means and moving it along the race means and by moving the plunger means into the second half of the reservoir for causing the shaving cream to be dispensed from the dispensing orifice in the distal end, adhesive tape means closing off the dispensing orificce, an inclined land molded on one of the inner surfaces of the reservoir at the midportion of the reservoir for locking the plunger against reverse movement after the projecting face overrides the inclined land, thus preventing removal of the plunger from the reservoirs and a second inclined land molded on said one inner surface of the reservoir at the furthest point of travel of the projecting face adjacent the dispensing orifice for locking the plunger against reverse movement after the projecting face overrides the second inclined land, thus preventing refilling of the reservoir through the orifice.

2. The apparatus of claim 1 wherein the dispensing orifice is disposed centrally within the distal end.

3. The apparatus of claim 1 wherein the the razor is securably affixed at the proximate end.

4. The apparatus of claim 1 wherein the razor is formed integrally with a blade means.

5. The apparatus of claim 1 wherein the shaving cream contains a biocidal material wherein the biocidal material is a material selected from the group of fungicides, viricides and bactericides.

6. The apparatus of claim 1 wherein the plunger means engages a positive stop means adjacent the distal end of the reservoir for tending to prevent the plunger means from being retractable.

* * * * *

UNITED STATES PATENT AND TRADEMARK OFFICE

CERTIFICATE OF CORRECTION

PATENT NO. : 4,696,106

DATED : September 29, 1987

INVENTOR(S) : Robert J. Cross and William A. Barabino

It is certified that error appears in the above-identified patent and that said Letters Patent is hereby corrected as shown below:

On the title page assignee should read

--(73) Assignee: William A. Barabino d/b/a Personal Hygiene Research Associates, N. Reading, Mass. --.

Signed and Sealed this

Twenty-fourth Day of May, 1988

*Attest:*

*Attesting Officer*

DONALD J. QUIGG

*Commissioner of Patents and Trademarks*